United States Patent [19]

Rowley et al.

[11] 4,348,955

[45] Sep. 14, 1982

[54] EXPLOSIVE CONTAINER

[75] Inventors: Edward K. Rowley, Beloeil; Allison A. Sprague, Ville Lemoyne, both of Canada

[73] Assignee: C-I-L Inc., Ontario, Canada

[21] Appl. No.: 208,944

[22] Filed: Nov. 21, 1980

[30] Foreign Application Priority Data

Dec. 14, 1979 [CA] Canada ..... 342100

[51] Int. Cl.[3] ..... F42B 3/00

[52] U.S. Cl. ..... 102/317; 102/315; 102/320; 102/331; 102/332

[58] Field of Search ..... 102/304, 315, 317, 320, 102/328, 331, 332

[56] References Cited

U.S. PATENT DOCUMENTS

| | | | |
|---|---|---|---|
| 1,562,123 | 11/1925 | Pitts | 102/331 |
| 2,636,437 | 4/1953 | Loving, Jr. | 102/328 |
| 3,185,092 | 5/1965 | Hamilton | 102/317 |
| 3,777,663 | 12/1973 | Brown | 102/331 |
| 4,000,696 | 1/1977 | Friant et al. | 102/331 |
| 4,006,687 | 2/1977 | Ridgeway | 102/315 X |
| 4,037,536 | 7/1977 | Griffith | 102/331 |

FOREIGN PATENT DOCUMENTS

| | | | |
|---|---|---|---|
| 1086566 | 9/1980 | Canada | 102/331 |

*Primary Examiner*—Peter A. Nelson

[57] ABSTRACT

In a blow-molded, cylindrical plastic container for explosives adapted for end-to-end coupling with like containers, an improvement is provided in the sealing of the container at the exposed explosives end. The improvement comprises a section of reduced diameter in the portion of the container immediately beyond the point of connection of a like container. The section of reduced diameter is adapted to receive therein a resilient plastic, disc-like sealing member in fluid-tight engagement. The seal prevents contamination of the explosive yet yields upon the pressure exerted by an adjacent, connected container.

5 Claims, 3 Drawing Figures

Fig. 1
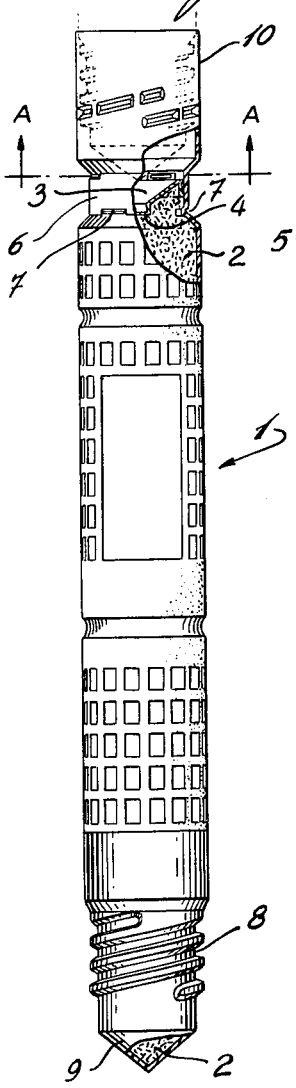
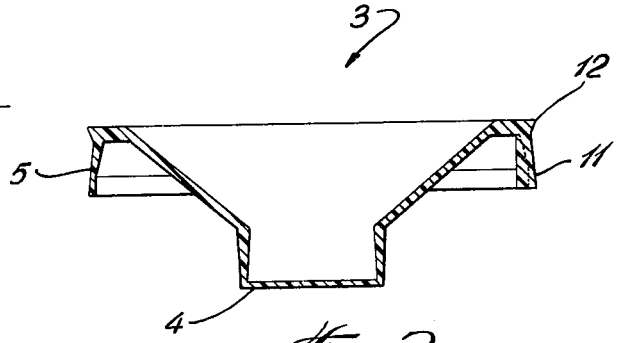
Fig. 2
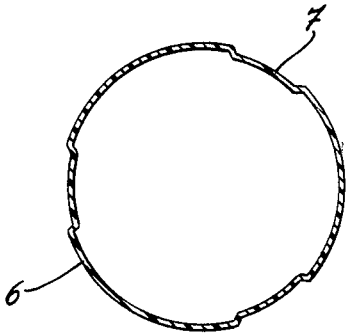
Fig. 3

EXPLOSIVE CONTAINER

This invention relates to an improvement in the type of cylindrical explosive container disclosed by John F. Hamilton in Canadian patent No. 730,436 issued Mar. 22, 1966 and in its corresponding U.S. Pat. No. 3,185,092 issued May 25, 1965. In particular, the present invention relates to an improved means of providing a protective closure or seal at the exposed explosive end of the container, which seal provides substantially leak proof protection against both loss of explosive from the container and the entry of contaminants into the container.

In brief, this invention relates to a blow-molded cylindrical plastic container filled with explosives and adapted for coupling to a like container to form an end-to-end train or column for insertion into a borehole, the container having an integrally sealed male end and an open female sealable end, the means by which the sealing of the open female end is accomplished being the principal subject matter of this invention.

The coupling means conventionally employed with the type of blow-molded cylindrical plastic container herein described normally comprises an external threaded or lugged male end of reduced diameter and a cooperating internally threaded or recessed female end, the male threaded or lugged end of one container being engagable with the recessed and counter-threaded female end of a succeeding container. In the improved container of the present invention, the same conventional coupling means is employed except that the present construction provides for a section of reduced diameter in that portion of the container immediately adjacent and beyond the said female threads or recesses, said reduced diameter section being adapted to receive and hold therein in substantially fluid-tight engagement a sealing member, the said sealing member comprising a substantially disc-like conically recessed, resilient or yieldable plastic member having a diameter equivalent to the internal diameter of the said container reduced diameter section, and said sealing member also comprising an integral, outwardly flared, skirt-like section around the circumference of said disc-like member, said skirt-like section extending in the direction of the apex of said conical recess and adapted for substantially hermetic engagement against the inner wall of said container reduced diameter section. The container reduced diameter section is also provided with internal projections which are adapted to seat the said resilient sealing member.

A preferred embodiment of the invention is disclosed by reference to the accompanying drawing wherein FIG. 1 is an elevational view, partly in cross-section of the improved container of the invention showing the shape and position of the sealing member;

FIG. 2 is a cross-sectional view of the sealing member of the invention; and

FIG. 3 is a sectional view taken along the line A—A of FIG. 1.

With reference to the figures of the drawings, a thin-wall cylindrical blow-molded plastic container 1 is shown filled with an explosive 2. A yieldable conically recessed plastic sealing member 3 is positioned within container 1 and adjacent explosive 2, the exterior apex of the cone 4 being pressed into or against explosive 2 and the side, skirt-like section 5 of member 3 being in tight but slidable engagement against the inner wall of a reduced diameter section 6 of container 1. Sealing member 3 is retained or seated in position by means of indentations or internal projections 7 formed in the wall of reduced diameter section 6. An externally threaded closed male end or coupling section 8 is provided on the end of container 1, the terminal portion 9 being conical and so compatible with the conical recess in sealing member 3 in an adjacent connected container. An internally threaded open female end or coupling section 10 is provided on the opposite end of container 1 and is adapted to receive the threaded section 8 of an adjacent container. The dimensions of the container at the male and female ends are so constructed to insure a snug fit when the threaded connection between containers is made. The indentations or projections 7, particularly shown in FIG. 3, are, because of the resilient nature of the plastic of the container, adapted to provide a snap-in function when sealing member 3 is inserted into the open female end 10. After filling with explosive 2 to a point close to the section of reduced diameter 6, the sealing member 3 is simply pressed into open container end 10, by means of an appropriate tool, so that it snaps over indentations 7 and is seated against the explosive 2 with the conical tip 4 pointed in the direction of the male end 8 and skirt 5 in contact with the inner circumference of wall 6. It will be seen by reference to FIG. 2, that skirt 5 of sealing member 3 comprises an outward flared section 11 at the leading edge (bottom) of skirt 5 and a second flare or bead 12 at the top of skirt 5. These two outwardly disposed sections serve to provide an augmented sealing action between skirt 5 and the inner wall of section 6 in the manner of a piston seal. Upward pressure from any expansion of explosive material 2 from, for example, changes in temperature, will cause further tightening of skirt 5 against wall section 6 as the cone section is lifted. Water, dust, etc. is prevented from ingress into the explosive by the tight sealing action provided by the flare or bead 12. Undue internal pressure within container 1 will not cause buldging or out-of-roundness of the container since sealing member 3 is adapted to snap out of its seat below the indentations 7 in the event excessive expansion of the explosive 2 occurs. It will be appreciated by those skilled in the art that the explosive charge 2 must occupy substantially all of the space within container 1 and below sealing member 3 in order to insure propagation of the detonation from container to container. As a result, any sealing member employed will nearly always be in close contact with the explosive and subject to possible movement and/or leakage of the explosive from the container. The improved explosive container of the present invention substantially eliminates this risk.

We claim:

1. In a blow-molded cylindrical plastic container adapted for filling with explosives and for connection with a like container to form a column of containers, said container comprising an external engagement means and integrally sealed end closure on a reduced diameter male end thereof and an internal engagement means on an open female end thereof, the said male and female ends being adapted for interconnection between like containers, the improvement comprising a section of reduced diameter in a portion of said container immediately adjacent but beyond the said female engagement means, said reduced diameter section being adapted to receive and retain therein in substantially hermetic engagement a sealing member comprising a substantially disc-like, conically recessed, yieldable plastic member having a diameter equivalent to the diameter of the said reduced diameter section, said sealing member also comprising an integral, outwardly flared skirt-like section around its circumference extending in a direction of the apex of said conical recess and adapted for sealable, slidable, engagement with the inner wall of said section of reduced container diameter.

2. A sealing member adapted to engage with the inner wall of an explosive-containing, blow-molded cylindrical plastic container to close and seal an open end of said container, the said sealing member comprising a substantially circular disc-like, conically recessed, yieldable plastic member having an integral, outwardly flared skirt-like section around its circumference, said skirt-like section extending in the direction of the apex of said conical recess.

3. A sealing member as claimed in claim 2 wherein the said skirt-like section also comprises a further bead-like protrusion on its outer circumferential surface.

4. An explosive container as claimed in claim 1 having explosive material disposed therein substantially throughout its length.

5. An explosive column comprising a plurality of end-to-end connected containers as claimed in claim 4.

* * * * *